United States Patent [19]

Apstein et al.

[11] 3,943,520

[45] Mar. 9, 1976

[54] NOSE CONE CAPACITIVELY TUNED WEDGE ANTENNA

[75] Inventors: Maurice Apstein; Frank Reggia, both of Bethesda, Md.; Howard S. Jones, Jr., Washington, D.C.

[73] Assignee: The United States of America as represented by the Secretary of the Army, Washington, D.C.

[22] Filed: Mar. 7, 1975

[21] Appl. No.: 556,527

[52] U.S. Cl. ..... 343/708; 343/746

[51] Int. Cl.[2] ..... H01Q 1/28

[58] Field of Search ..... 343/705, 708, 767, 785, 343/746

[56] References Cited

UNITED STATES PATENTS 3,868,694 2/1975 Meinki ..... 343/785

*Primary Examiner*—Eli Lieberman

*Attorney, Agent, or Firm*—Nathan Edelberg; Robert P. Gibson; Saul Elbaum

[57] ABSTRACT

Disclosed herein is an antenna system for use with small projectile nose cones (metal). The antenna comprises a wedge shaped metallized dielectric material having an electrical length equal to one-quarter wavelength as measured inside the center line of the wedge. The metallic coating covering both the top and bottom of the wedge is provided to form a parallel plate radiator. The metallic coating is also extended across the base of the wedge to define an RF short circuit at the base and an open circuit at the apex. An RF coupling probe extending into the wedge is located at a convenient impedance matching point near the base of the wedge. The operating frequency of the antenna may be capacitively tuned (either electrically or mechanically) by means of a variable capacitor connected across the open circuit end (the apex) of the antenna. Typically the dielectric comprises teflon-fiberglass or ceramic material although an air dielectric is also usable. Associated electronic circuitry is located within the nose cone adjacent the wedge antenna utilizing the available open space within the nose cone. Due to the metallic coating which comprises the parallel plate radiator, any electronic circuitry is electrically isolated from the antenna.

9 Claims, 7 Drawing Figures

NOSE CONE CAPACITIVELY TUNED WEDGE ANTENNA

The invention described herein may be manufactured, used, and licensed by and for the United States Government for governmental purposes without the payment to us of any royalties thereon.

BACKGROUND OF THE INVENTION

Since the advent of projectiles utilizing proximity fusing systems, telemetry, missile guidance, and other types of electronic communications, a problem in the design of such systems has been to provide an antenna which is small, compact, and will not take up too much space within the projectile. This is especially important where the projectile has a fixed size and where space and weight limitations are critical problems in the design of self-contained fusing and telemetry systems. Another problem has been to construct antennas in small diameter bodies which can handle signals at the lower microwave frequencies (600 to 1000 MHz). It is also important that the electrical characteristics of these antennas meet design specifications. This normally means that the antenna must have certain specified radiation pattern characteristics, impedance matching and sufficient bandwidth and gain to fulfill the telemetry function.

Prior systems have utilized small antennas which are usually mounted within the nose cone structure of the projectile. These antennas used in prior systems normally utilized radiation elements, such as loops, stubs and ring networks that were enclosed by the dielectric nose cone or body of the projectile. Such systems have proven inadequate in that they exhibit a tendency to interfere electrically with radiation field and the electronic components which are also located within the nose cone of the projectile. Furthermore, such systems have proven to be less efficient and more difficult to design and construct, and also far more costly to produce than is desirable.

It is, therefore, a primary object of this invention to provide a projectile with an antenna system that utilizes a minimum of space within the projectile.

It is another object of this invention to provide a small, compact antenna system which is efficient in its electrical characteristics and yet is extremely light weight.

Still another object of this invention is to provide an antenna system for a projectile which can be incorporated as part of the nose cone structure of the projectile.

Yet another object is to provide an antenna system which can be easily constructed and is inexpensive to manufacture.

Yet another object is to provide an antenna that is able to withstand high aerodynamic temperatures without mechanical distortion and with good operating efficiency.

An additional object of the invention is to provide an antenna system which can be incorporated into the nose cone of a projectile while at the same time providing complete electrical isolation between the antenna and the associated electronics which are also located within the nose cone.

These and other objects and advantages of the invention will become more apparent with reference to the following specification, drawings and appended claims.

SUMMARY OF THE INVENTION

Briefly, in accordance with this invention, an antenna system is provided for use with metal nose cones. The antenna comprises a wedge shaped dielectric material having an electrical length equal to one-quarter wavelength as measured inside the center line of the wedge. A metallic coating covering both the top and bottom of the wedge is provided to form a parallel plate radiator. The metallic coating is also extended across the base of the wedge to define a short circuit at the base and an open circuit at the apex. An RF coupling probe extending into the wedge is located at a suitable impedance matching point near the base of the wedge. The operating frequency of the antenna may be capacitively tuned by means of a variable capacitor (either electrical or mechanical) connected across the open circuit end (the apex) of the antenna. Typically the dielectric comprises teflon-fiberglass or ceramic material although an air dielectric is also usable. Associated electronic circuitry is located within the nose cone adjacent the wedge antenna utilizing the available open space within the nose cone. Due to the metallic coating which comprises the parallel plate radiator and the metal nose cone, any electronic circuitry is electrically isolated from the antenna.

BRIEF DESCRIPTION OF THE DRAWINGS

The foregoing invention will be more readily appreciated from the following detailed description taken together with the drawings in which.

DESCRIPTION OF THE PREFERRED EMBODIMENTS

Figure 1:
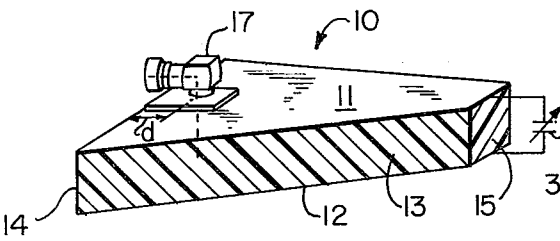
FIG. 1 illustrates one embodiment of the present invention.

Referring now to FIG. 1, antenna 10 is shown as having a wedge-shaped dielectric 13 provided with a metallic coating 11 on the top surface thereof and an additional metallic coating 12 on the bottom surface thereof to provide a parallel plate radiator. An additional metallic coating 14 is provided to extend across the base of antenna 10 so as to provide a short circuit end. The apex 15 is provided with a variable capacitor 16 for capacitively tuning (electrically or mechanically) the operating frequency of the wedge-shaped antenna. The electrical length of the antenna is designed to be one-quarter wavelength and is provided with an RF input probe located a distance d from the short circuit end. The RF probe is positioned at a suitable impedance matching point (i.e., 50 ohm impedance point) generally at a distance of approximately one-quarter of an inch from the short circuit end.

The embodiment illustrated in FIG. 1 is designed to operate in the 900 MHz frequency range. The embodiment is typically 2½ inches long, and it has a width at top and base of ½ inch and 2 inches, respectively. The thickness of the dielectric material can be typically from one-sixteenth to one-quarter inch of teflon-fiberglass material.

Figure 2:
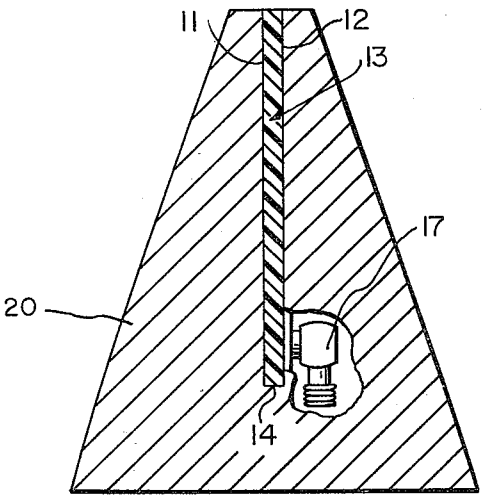
FIG. 2 illustrates a cross-sectional side view of the embodiment of FIG. 1.

FIG. 2 illustrates a side cross-sectional view of the embodiment of FIG. 1 in which the antenna 10 is physically located within a nose cone structure 20. The overall dimensions of antenna 10 are cut to physically fit the space provided for within nose cone 20 so as to be flush therewith.

Figure 3:
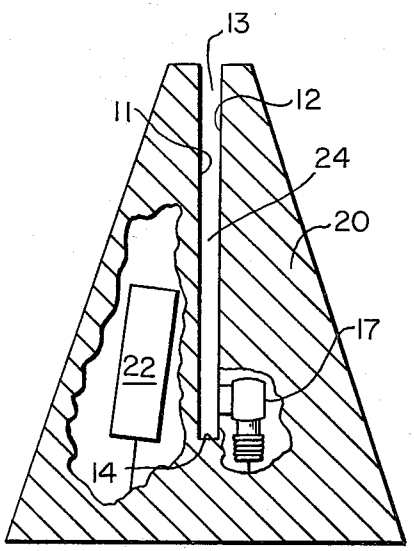
FIG. 3 illustrates another embodiment of the present invention.

In FIG. 3 is illustrated the concept of a parallel plate wedge-shaped radiator in which the dielectric material is air. Basically, a slot 24 is cut inside the metal nose cone 20 to have a length equal to one-quarter wavelength. The antenna, therefore, consists of a wedge-shaped hollow radiator defined by an open end 13 at the apex, two long parallel metallic paltes 11 and 12 short circuited at the base 14 and provided with an RF probe 17. As is clearly apparent from this arrangement, any associated electronic circuitry 22 which is located within the metal nose cone is fully electrically isolated from the antenna.

Figure 4:
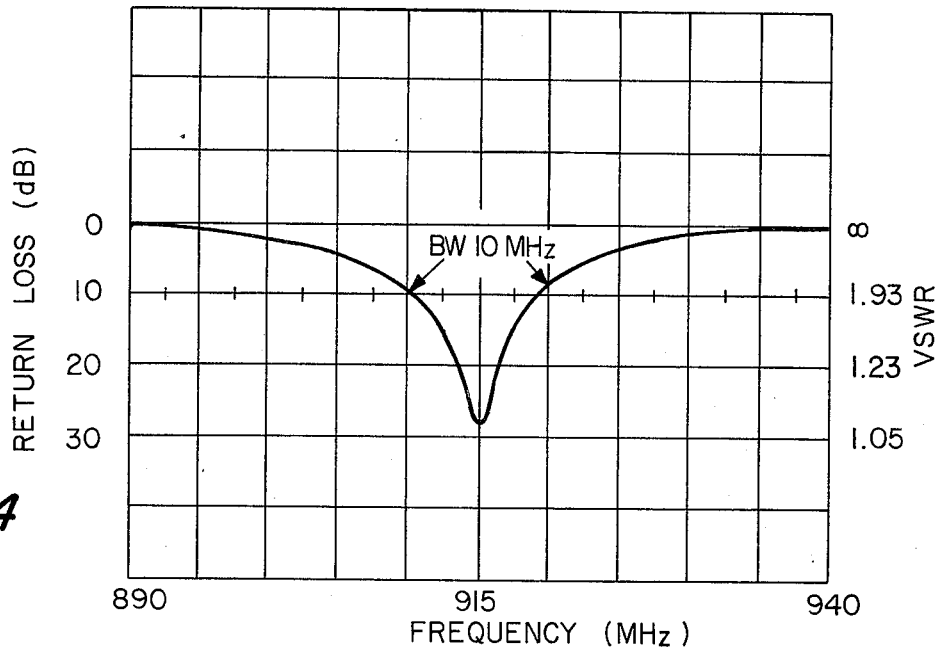
FIG. 4 illustrates the bandwidth characteristics of the embodiment shown in FIG. 1.

Typical bandwidth characteristics from 890 MHz to 940 MHz are illustrated in FIG. 4. These results show the magnitude of the reflection loss (dB) at the left and the corresponding input VSWR of the antenna at the right. As seen in FIG. 4, an operating bandwidth (VSWR less than 2.0) of 10 MHz centered at the 915 MHz design frequency is not difficult to achieve with this type of projectile fuse antenna, including self-propelled projectiles such as rockets and missiles. The RF coupling probe in this embodiment was placed on the center line of the wedge, one-quarter inch from the short circuit end. In this embodiment, the width at the top of the wedge was one-half inch and at the bottom it was 2¼ inches.

Figure 5:
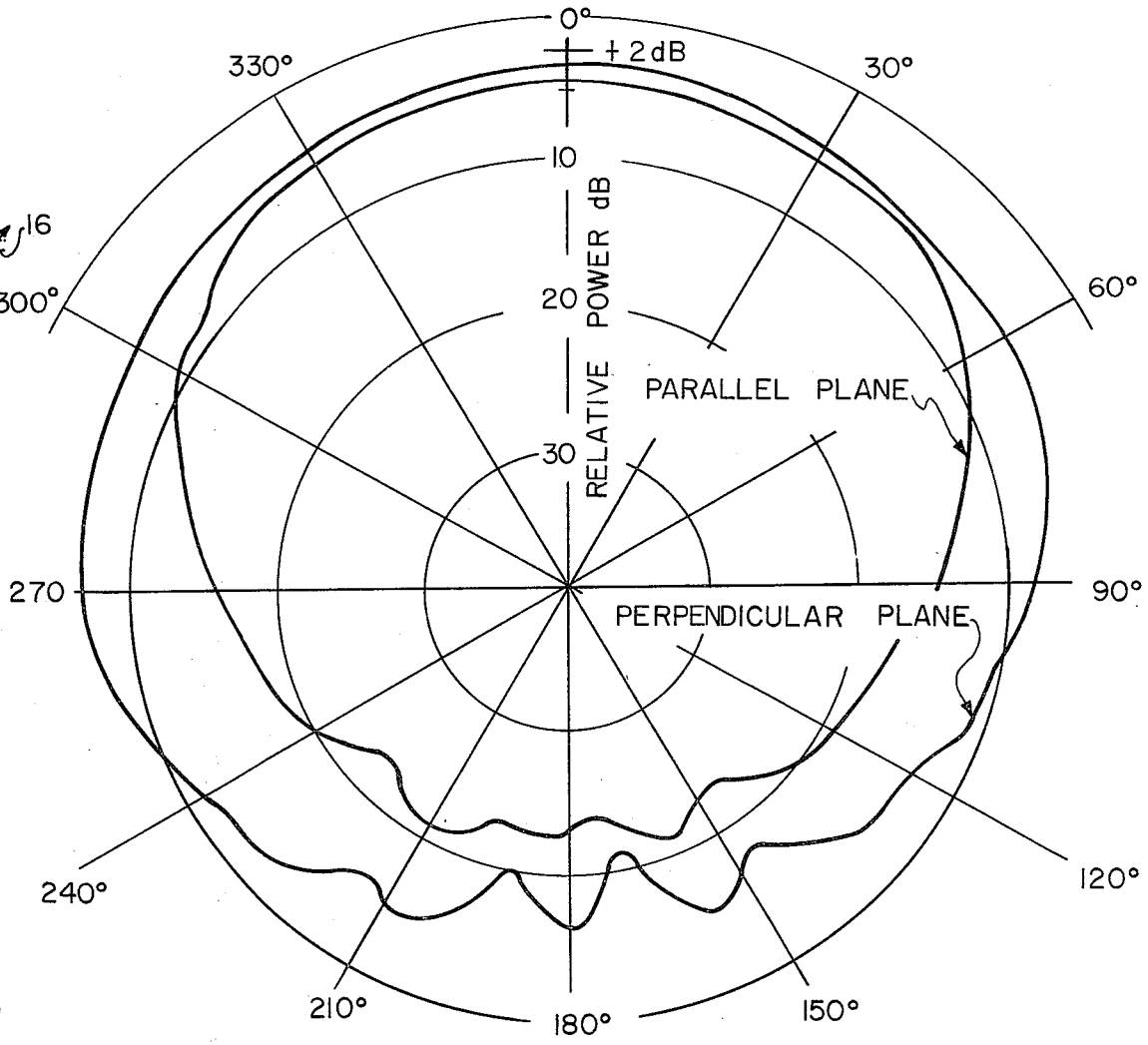
FIG. 5 illustrates the far field radiation pattern of the embodiment illustrated in FIG. 1.

Far field radiation patterns in both parallel and perpendicular elevation planes for the above antenna placed at the center of a metal nose cone 3½ inches long are illustrated in FIG. 5. These results were taken at the 915 MHz frequency in a large anechoic chamber. An RF coaxial choke embedded in an absorbing ground plane was used at the input to minimize re-radiation from the feed cable. The measured gain in the forward direction for this type of projectile antenna is approximately zero dBi.

Figure 7:
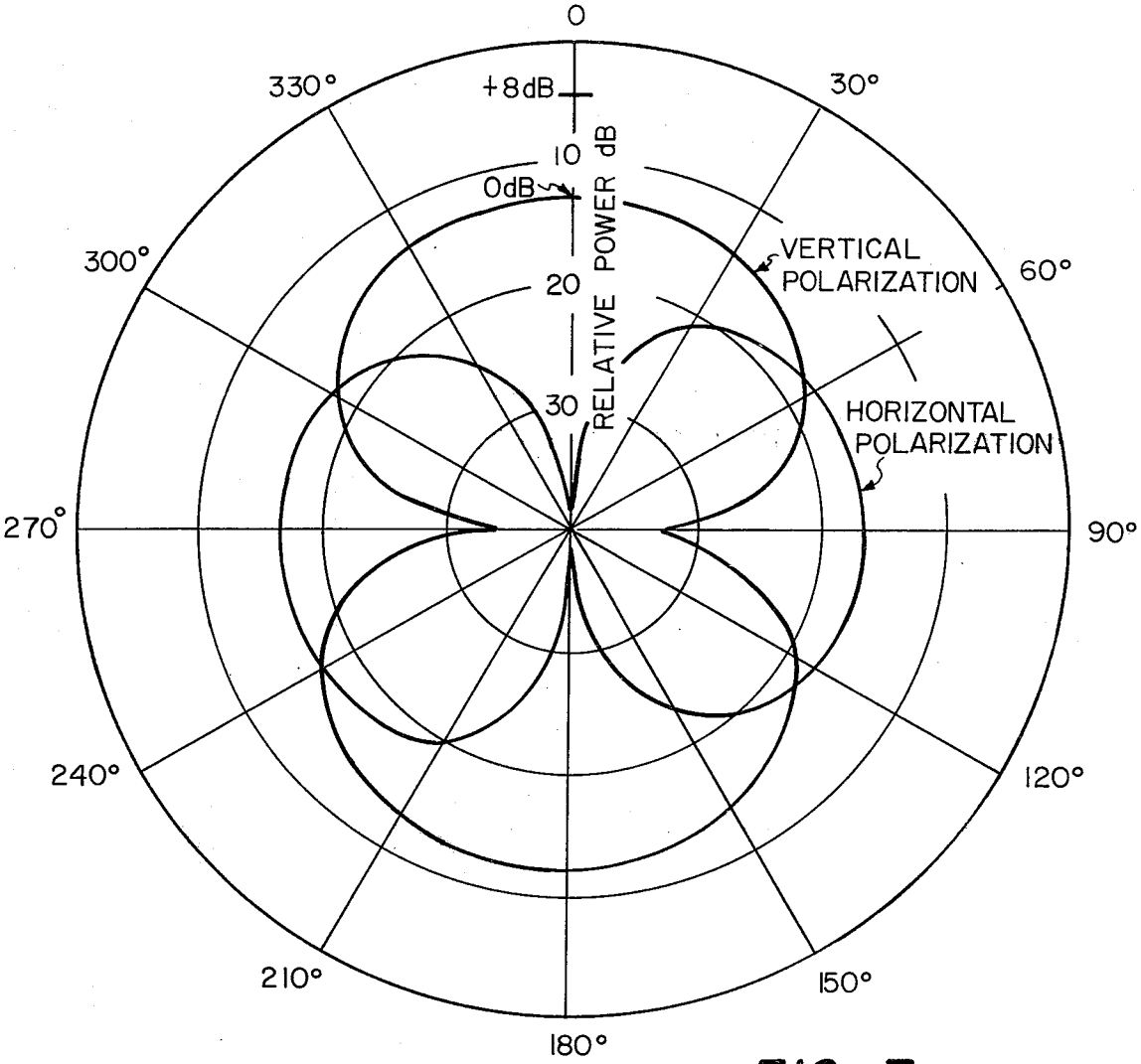
FIG. 7 illustrates the azimuthal patterns of the same wedge antenna on the 81 mm projectile.
Figure 6:
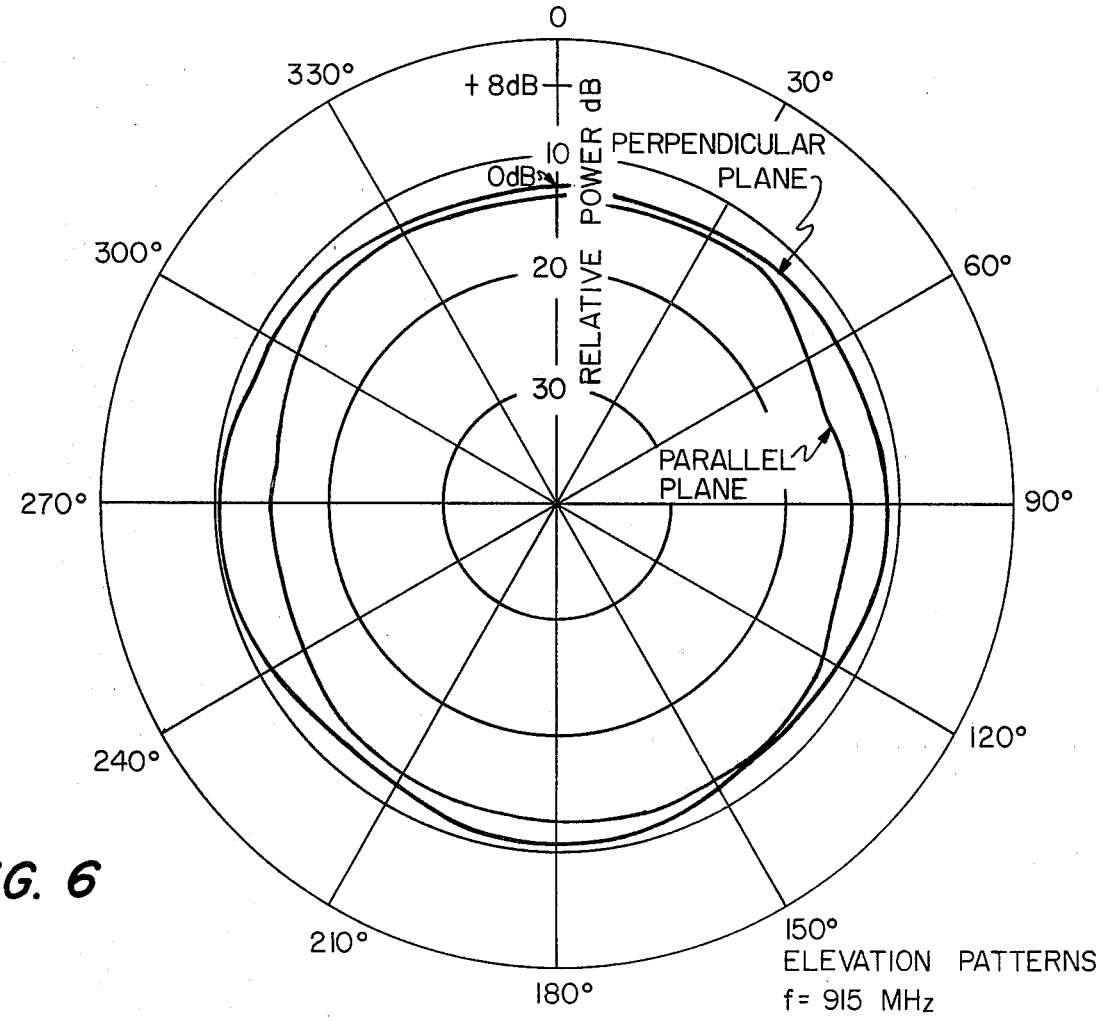
FIG. 6 illustrates the elevation patterns of the device illustrated in FIG. 1 as mounted on an 81 mm projectile.

The elevation patterns illustrated in FIG. 6 were taken in planes perpendicular and parallel to the plane of the wedge antenna situated on an 81 mm projectile. The azimuthal patterns in both vertical and horizontal polarizations for the same wedge antenna on the 81 mm projectile are given in FIG. 7. These radiation characteristics are more complex than those obtained in the elevation planes, being dipolar in shape for both polarizations. The horizontally polarized radiation component is primarily due to the RF electric field radiated from the vertical slot of the wedge antenna. The vertically polarized component of the radiation field is due to the RF currents along the length of the cylindrical cone.

Results indicate radiation efficiencies for the parallel plane wedge antennas to vary from 40 to 80 percent depending on the thickness of the teflon-fiberglass wedge. Holding other physical dimensions and material properties constant, efficiencies greater than 40, 60 and 80 percent were measured for wedge thicknesses of one-sixteenth one-eighth and one-fourth inch, respectively.

It is apparent from the foregoing that we have described a unique and most useful wedge-shaped antenna for use within projectile nose cones. It should be understood, however, that we do not desire to be limited to the exact details of construction shown and described, for obvious modifications can be made by a person skilled in the art.

We claim as our invention:

1. An antenna for use with metal nose cones comprising:

a. a wedge-shaped dielectric material having an electrical length of one-quarter wavelength measured inside the center line of the wedge;

b. metallic electrodes covering the top and bottom of said wedge to form a parallel plate radiator, said electrodes being connected across the base of said wedge to define an RF short circuit at the base;

c. an RF coupling probe extending into said wedge at a point adjacent said base; and d. means for tuning said antenna.

2. The device defined in claim 1 wherein said means for tuning comprises a variable capacitor connected across the open circuit end at the apex of said wedge-shaped antenna.

3. The device defined in claim 2 wherein said dielectric material comprises low-loss dielectric material such as teflon-fiberglass.

4. The device defined in claim 3 wherein said RF coupling probe is located along the centerline of said wedge for impedance matching.

5. The device defined in claim 4 wherein the apex of said wedge is rounded to conform to the shape of a projectile nose cone.

6. The device of claim 1 wherein said wedge is defined by an open slot within a hollow metal nose cone.

7. The device of claim 6 wherein said dielectric is air.

8. The device claim 7 wherein associated electronic circuitry is located within said hollow nose cone adjacent said antenna.

9. The device of claim 2 wherein said variable capacitor is electrically tuned for rapidly changing the operating frequency range of the antenna.

* * * * *